US006741025B2

(12) United States Patent
Tuck et al.

(10) Patent No.: US 6,741,025 B2
(45) Date of Patent: May 25, 2004

(54) FIELD ELECTRON EMISSION MATERIALS WITH INSULATING MATERIAL DISPOSED IN PARTICULAR AREA AND DEVICES

(75) Inventors: Richard Allan Tuck, Slough (GB); Hugh Edward Bishop, Abingdon (GB)

(73) Assignee: Printable Field Emitters Limited, Chilton (GB)

( * ) Notice: Subject to any disclaimer, the term of this patent is extended or adjusted under 35 U.S.C. 154(b) by 0 days.

(21) Appl. No.: 09/555,559

(22) PCT Filed: Dec. 3, 1998

(86) PCT No.: PCT/GB98/03582

§ 371 (c)(1),
(2), (4) Date: May 31, 2000

(87) PCT Pub. No.: WO99/28939

PCT Pub. Date: Jun. 10, 1999

(65) Prior Publication Data

US 2003/0137236 A1 Jul. 24, 2003

(30) Foreign Application Priority Data

Dec. 4, 1997 (GB) ..... 9725658
Sep. 10, 1998 (GB) ..... 9819647

(51) Int. Cl.[7] ..... H01J 1/62; H01J 63/04

(52) U.S. Cl. ..... 313/495; 313/257; 313/292; 313/258; 313/609; 445/24; 445/25

(58) Field of Search ..... 313/495, 257, 313/292, 258, 609, 496, 497, 310, 346 R; 445/24, 25; 427/77

(56) References Cited

U.S. PATENT DOCUMENTS 5,663,608 A * 9/1997 Jones et al. ..... 313/309
5,747,918 A 5/1998 Eom
5,759,080 A 6/1998 Yoshioka
6,097,139 A * 8/2000 Tuck et al. ..... 313/310

FOREIGN PATENT DOCUMENTS

EP 0675519 A1 10/1995
EP 0681312 A1 11/1995
WO WO-91/05361 A * 4/1991
WO WO-97/23002 A * 6/1997
WO WO 98/11588 A1 3/1998

* cited by examiner

*Primary Examiner*—Kenneth J. Ramsey
*Assistant Examiner*—Kevin Quarterman
(74) *Attorney, Agent, or Firm*—Barnes & Thornburg

(57) ABSTRACT

A field electron emission material is formed by coating a substrate (221, 230) having an electrically conductive surface with a plurality of electrically conductive particles (223, 231). Each particle has a layer of electrically insulating material (222, 232) disposed either in a first location between the conductive surface of the substrate (221) and the particle (223), or in a second location between the particle (231) and the environment (237) in which the field electron emission material is disposed, but not in both of such first and second locations, so that at least some of the particles (223, 231) form electron emission sites at such first or second locations. A number of field emission devices are disclosed, utilizing such electron emission material.

61 Claims, 13 Drawing Sheets

FIELD ELECTRON EMISSION MATERIALS WITH INSULATING MATERIAL DISPOSED IN PARTICULAR AREA AND DEVICES

BACKGROUND OF THE INVENTION

This invention relates to field electron emission materials, and devices using such materials.

In classical field electron emission, a high electric field of, for example, $\approx 3\times10^9$ V $m^{-1}$ at the surface of a material reduces the thickness of the surface potential barrier to a point at which electrons can leave the material by quantum mechanical tunnelling. The necessary conditions can be realised using atomically sharp points to concentrate the macroscopic electric field. The field electron emission current can be further increased by using a surface with a low work function. The metrics of field electron emission are described by the well known Fowler-Nordheim equation.

There is considerable prior art relating to tip based emitters, which term describes electron emitters and emitting arrays which utilise field electron emission from sharp points (tips). The main objective of workers in the art has been to place an electrode with an aperture (the gate) less than 1 $\mu$m away from each single emitting tip, so that the required high fields can by achieved using applied potentials of 100V or less—these emitters are termed gated arrays. The first practical realisation of this was described by C A Spindt, working at Stanford Research Institute in California (*J. Appl. Phys.* 39, 7, pp 3504–3505, (1968)). Spindt's arrays used molybdenum emitting tips which were produced, using a self masking technique, by vacuum evaporation of metal into cylindrical depressions in a $SiO_2$ layer on a Si substrate.

In the 1970s, an alternative approach to produce similar structures was the use of directionally solidified eutectic alloys (DSE). DSE alloys have one phase in the form of aligned fibres in a matrix of another phase. The matrix can be etched back leaving the fibres protruding. After etching, a gate structure is produced by sequential vacuum evaporation of insulating and conducting layers. The build up of evaporated material on the tips acts as a mask, leaving an annular gap around a protruding fibre.

An important approach is the creation of gated arrays using silicon micro-engineering. Field electron emission displays utilising this technology are being manufactured at the present time, with interest by many organisations worldwide.

Major problems with all tip-based emitting systems are their vulnerability to damage by ion bombardment, ohmic heating at high currents and the catastrophic damage produced by electrical breakdown in the device. Making large area devices is both difficult and costly.

In about 1985, it was discovered that thin films of diamond could be grown on heated substrates from a hydrogen-methane atmosphere, to provide broad area field emitters—that is, field emitters that do not require deliberately engineered tips.

In 1991, it was reported by Wang et al (*Electron. Lett.,* 27, pp 1459–1461 (1991)) that field electron emission current could be obtained from broad area diamond films with electric fields as low as 3 MV $m^{-1}$. This performance is believed by some workers to be due to a combination of the negative electron affinity of the (111) facets of diamond and the high density of localised, accidental graphite inclusions (*Xu, Latham and Tzeng: Electron. Lett.,* 29, pp 1596–159 (1993)) although other explanations are proposed.

Coatings with a high diamond content can now be grown on room temperature substrates using laser ablation and ion beam techniques. However, all such processes utilise expensive capital equipment and the performance of the materials so produced is unpredictable.

S I Diamond in the USA has described a field electron emission display (FED) that uses as the electron source a material that it calls Amorphic Diamond. The diamond coating technology is licensed from the University of Texas. The material is produced by laser ablation of graphite onto a substrate.

From the 1960s onwards another group of workers has been studying the mechanisms associated with electrical breakdown between electrodes in vacuum. It is well known (*Latham and Xu, Vacuum,* 42, 18, pp 1173–1181 (1991)) that as the voltage between electrodes is increased no current flows until a critical value is reached at which time a small noisy current starts flowing. This current increases both monotonically and stepwise with electric field until another critical value is reached, at which point it triggers an arc. It is generally understood that the key to improving voltage hold-off is the elimination of the sources of these pre-breakdown currents. Current understanding shows that the active sites are either metal-insulator-vacuum (MIV) structures formed by embedded dielectric particles or conducting flakes sitting on insulating patches such as the surface oxide of the metal. In both cases, the current comes from a hot electron process that accelerates the electrons resulting in quasi-thermionic emission over the surface potential barrier. This is well described in the scientific literature e.g. *Latham, High Voltage Vacuum Insulation, Academic Press* (1995).

FIG. 1*a* of the accompanying diagrammatic drawings shows one of these situations in which a conducting flake is the source of emission. The flake 203 sits on an insulating layer 202 above a metal substrate 201 and probes the field. This places a high electrical field across the insulating layer formed by for example the surface oxide. This voltage probing has been named the "antenna effect". At a critical field the insulating layer 202 changes its nature and creates an electro-formed conducting channel 204. A proposed energy level diagram for such a channel is shown in FIG. 1*b* of the accompanying diagrammatic drawings. In this model electrons 212 near the Fermi level 211 in the metal can tunnel from the metal 210 into the insulator 216 and drift in the penetrating field until they are near the surface. The high field 213 in the surface region accelerates the electrons and increases their temperature to ~1000° C. It is not known precisely what changes occur in the region of the channel but a key feature must be the neutralisation of the "traps" 217 that result from defects in the material. The electrons are then emitted quasi-thermionically over the surface potential barrier 215. The physical location of the source of these electrons 205 is shown in FIG. 1*a* and, whilst a proportion of them will initially be intercepted by the particle, it will eventually charge up to a point at which the net current flow into it is zero.

It is to be appreciated that the emitting sites referred to in this work are unwanted defects, occurring sporadically in small numbers, and the main objective in vacuum insulation work is to avoid them. For example, as a quantitative guide, there may be only a few such emitting sites per $cm^2$, and only one in $10^3$ or $10^4$ visible surface defects will provide such unwanted and unpredictable emission.

Accordingly, the teachings of this work have been adopted by a number of technologies (e.g. particle accelerators) to improve vacuum insulation.

Latham and Mousa (*J. Phys. D: Appl. Phys.* 19, pp 699–713 (1986)) describe composite metal-insulator tip-based emitters using the above hot electron process and in 1988 S Bajic and R V Latham, (*Journal of Physics D Applied Physics, vol.* 21 200–204 (1988)), described a composite that created a high density of metal-insulator-metal-insulator-vacuum (MIMIV) emitting sites. The composite had conducting particles dispersed in an epoxy resin. The coating was applied to the surface by standard spin coating techniques.

Much later in 1995 Tuck, Taylor and Latham (GB 2304989) improved the above MIMIV emitter by replacing the epoxy resin with an inorganic insulator that both improved stability and enabled it to be operated in sealed off vacuum devices.

All of the inventions described above rely on hot electron field emission of the type responsible for pre-breakdown currents but, so far, no method has yet been proposed to produce emitters with a plurality of conducting particle MIV emitters in a controlled manner.

Preferred embodiments of the present invention aim to provide cost effective broad area field emitting materials and devices. The materials may be used in devices that include: field electron emission display panels; high power pulse devices such as electron MASERS and gyrotrons; crossed-field microwave tubes such as CFAs; linear beam tubes such as klystrons; flash x-ray tubes; triggered spark gaps and related devices; broad area x-ray sources for sterilisation; vacuum gauges; ion thrusters for space vehicles; particle accelerators; ozonisers; and plasma reactors.

SUMMARY OF THE INVENTION

According to a first aspect of the present invention there is provided a method of forming a field electron emission material, comprising the step of disposing on a substrate having an electrically conductive surface a plurality of electrically conductive particles, each with a layer of electrically insulating material disposed either in a first location between said conductive surface and said particle, or in a second location between said particle and the environment in which the field electron emission material is disposed, but not in both of said first and second locations, such that at least some of said particles form electron emission sites at said first or second locations where said electrically insulating material is disposed.

Thus, in preferred embodiments of the invention, an emitter may be formed so that a MIV channel is either at the base or the top of the particle. If the MIV channel is at the base, as in FIG. 1*a,* the antenna effect enhances the electric field across the channel according to the ratio of particle height normal to the surface and insulator thickness. However, it is equally possible to form a MIV channel on the top of the particle by overcoating a particle in electrical contact with the surface with an insulating layer. In this case the field enhancement is based upon the particle shape. For all reasonable particle shapes, one will typically be limited to a field enhancement factor of approximately ten. The arrangement with the lower channel will usually give the lowest switch-on field. The arrangement with the channel on top can be far more robust and would find application in pulsed power devices where high electric fields and large electrostatic forces are the norm and very high current densities are required.

Preferably the dimension of said particles normal to the surface of the conductor is significantly greater than the thickness of said layer of insulating material.

Preferably, said dimension substantially normal to the surface of said particle is at least 10 times greater than said thickness.

Preferably, said dimension substantially normal to the surface of said particle is at least 100 times greater than each said thickness.

In a preferred example, the thickness of said insulating material may be in the range 10 nm to 100 nm (100 Å to 1000 Å) and said particle dimension in the range 1 $\mu$m to 10 $\mu$m.

There may be provided a substantially single layer of said conductive particles each having their dimension substantially normal to the surface in the range 0.1 $\mu$m to 400 $\mu$m.

Said insulating material may comprise a material other than diamond.

Preferably, said insulating material is an inorganic material.

Preferably, said inorganic insulating material comprises a glass, lead based glass, glass ceramic, melted glass or other glassy material, ceramic, oxide ceramic, oxidised surface, nitride, nitrided surface, boride ceramic, diamond, diamond-like carbon or tetragonal amorphous carbon.

Glassy materials may be formed by processing an organic precursor material (eg heating a polysiloxane) to obtain an inorganic glassy material (eg silica). Other examples are given in the description below.

Each said electrically conductive particle may be substantially symmetrical.

Each said electrically conductive particle may be of substantially rough-hewn cuboid shape.

Each said electrically conductive particle may be of substantially spheroid shape with a textured surface.

A field electron emission material as above may comprise a plurality of said conductive particles, each having a longest dimension and preferentially aligned with their longest dimension substantially normal to the substrate.

A field electron emission material as above may comprise a plurality of conductive particles having a mutual spacing, centre-to-centre, of at least 1.8 times their smallest dimension.

Preferably, each said particle is, or at least some of said particles are, selected from the group comprising metals, semiconductors, electrical conductors, graphite, silicon carbide, tantalum carbide, hafnium carbide, zirconium carbide, boron carbide, titanium diboride, titanium carbide, titanium carbonitride, the Magneli sub-oxides of titanium, semi-conducting silicon, III–V compounds and II–VI compounds.

Most metals, most semiconductors and most electrical conductors are suitable materials.

In the case of emitters with a lower channel, or emitters with a channel on top where the particle is partially covered in said insulating material, each said particle may comprise a gettering material.

Preferably, said surface is coated with said particles by means of an ink containing said particles and said insulating material to form said insulating layer, the properties of said ink being such that said particles have portions which are caused to project from said insulating material, uncoated by the insulating material, as a result of the coating process.

Preferably, said ink is applied to said electrically conductive surface by a printing process.

Said electrically conductive particle(s) and/or inorganic electrically insulating material may be applied to said electrically conductive substrate in a photosensitive binder to permit later patterning.

The insulator component of said ink may be formed by, but not limited to, the step of fusing, sintering or otherwise joining together a mixture of particles or in situ chemical reaction.

The insulating material may then comprise a glass, glass ceramic, ceramic, oxide ceramic, oxide, nitride, boride, diamond, polymer or resin.

Each said electrically conductive particle may comprise a fibre chopped into a length longer than its diameter.

Said particles may be formed by the deposition of a conducting layer upon said insulating layer and its subsequent patterning, either by selective etching or masking, to form isolated islands that function as said particles.

Said particles may be applied to said conductive surface by a spraying process.

Said conductive particles may be formed by depositing a layer that subsequently crazes, or is caused to craze, into substantially electrically isolated raised flakes.

Said conducting layer may be a metal, conducting element or compound, semiconductor or composite.

A method as above may include the step of selectively eliminating field electron emission material from specific areas by removing the particles by etching techniques.

Preferably, the distribution of said sites over the field electron emission material is random.

Said sites may be distributed over the field electron emission material at an average density of at least $10^2$ $cm^{-2}$.

Said sites may be distributed over the field electron emission material at an average density of at least $10^3$ $cm^{-2}$, $10^4$ $cm^{-2}$ or $10^5$ $cm^{-2}$.

Preferably, the distribution of said sites over the field electron emission material is substantially uniform.

The distribution of said sites over the field electron emission material may have a uniformity such that the density of said sites in any circular area of 1 mm diameter does not vary by more than 20% from the average density of distribution of sites for all of the field electron emission material.

Preferably, the distribution of said sites over the field electron emission material when using a circular measurement area of 1 mm in diameter is substantially Binomial or Poisson.

The distribution of said sites over the field electron emission material may have a uniformity such that there is at least a 50% probability of at least one emitting site being located in any circular area of 4 $\mu$m diameter.

The distribution of said sites over the field electron emission material may have a uniformity such that there is at least a 50% probability of at least one emitting site being located in any circular area of 10 $\mu$m diameter.

A method as above may include the preliminary step of classifying said particles by passing a liquid containing particles through a settling tank in which particles over a predetermined size settle such that liquid output from said tank contains particles which are less than said predetermined size and which are then coated on said substrate.

The invention extends to a field electron emission material produced by any of the above methods.

According to a further aspect of the present invention, there is provided a field electron emission device comprising a field electron emission material as above, and means for subjecting said material to an electric field in order to cause said material to emit electrons.

A field electron emission device as above may comprise a substrate with an array of emitter patches of said field electron emission material, and control electrodes with aligned arrays of apertures, which electrodes are supported above the emitter patches by insulating layers.

Said apertures may be in the form of slots.

A field electron emission device as above may comprise a plasma reactor, corona discharge device, silent discharge device, ozoniser, an electron source, electron gun, electron device, x-ray tube, vacuum gauge, gas filled device or ion thruster.

The field electron emission material may supply the total current for operation of the device.

The field electron emission material may supply a starting, triggering or priming current for the device.

A field electron emission device as above may comprise a display device.

A field electron emission device as above may comprise a lamp.

Preferably, said lamp is substantially flat.

A field electron emission device as above may comprise an electrode plate supported on insulating spacers in the form of a cross-shaped structure.

The field electron emission material may be applied in patches which are connected in use to an applied cathode voltage via a resistor.

Preferably, said resistor is applied as a resistive pad under each emitting patch.

A respective said resistive pad may be provided under each emitting patch, such that the area of each such resistive pad is greater than that of the respective emitting patch.

Preferably, said emitter material and/or a phosphor is/are disposed upon one or more one-dimensional array of conductive tracks which are arranged to be addressed by electronic driving means so as to produce a scanning illuminated line.

Such a field electron emission device may include said electronic driving means.

The environment may be gaseous, liquid, solid, or a vacuum.

A field electron emission device as above may include a gettering material within the device.

Preferably, said gettering material is affixed to the anode.

Said gettering material may be affixed to the cathode. Where the field electron emission material is arranged in patches, said gettering material may be disposed within said patches.

In one embodiment of the invention, a field emission display device as above may comprise an anode, a cathode, spacer sites on said anode and cathode, spacers located at at least some of said spacer sites to space said anode from said cathode, and said gettering material located on said anode at others of said spacer sites where spacers are not located.

In the context of this specification, the term "spacer site" means a site that is suitable for the location of a spacer to space an anode from a cathode, irrespective of whether a spacer is located at that spacer site.

Preferably, said spacer sites are at a regular or periodic mutual spacing.

In a field electron emission device as above, said cathode may be optically translucent and so arranged in relation to the anode that electrons emitted from the cathode impinge upon the anode to cause electro-luminescence at the anode, which electro-luminescence is visible through the optically translucent cathode.

It will be appreciated that the electrical terms "conducting" and "insulating" can be relative, depending upon the basis of their measurement. Semiconductors have useful conducting properties and, indeed, may be used in the present invention as conducting particles. In the context of this specification, each said conductive particle has an electrical conductivity at least $10^2$ times (and preferably at least $10^3$ or $10^4$ times) that of the insulating material.

BRIEF DESCRIPTION OF THE DRAWINGS

For a better understanding of the invention, and to show how embodiments of the same may be carried into effect, reference will now be made, by way of example, to the accompanying diagrammatic drawings, in which.

DESCRIPTION OF THE PREFERRED EMBODIMENTS

The illustrated embodiments of the invention provide materials based upon an MIV emission process with improved performance and usability, together with devices that use such materials.

Figure 1A:
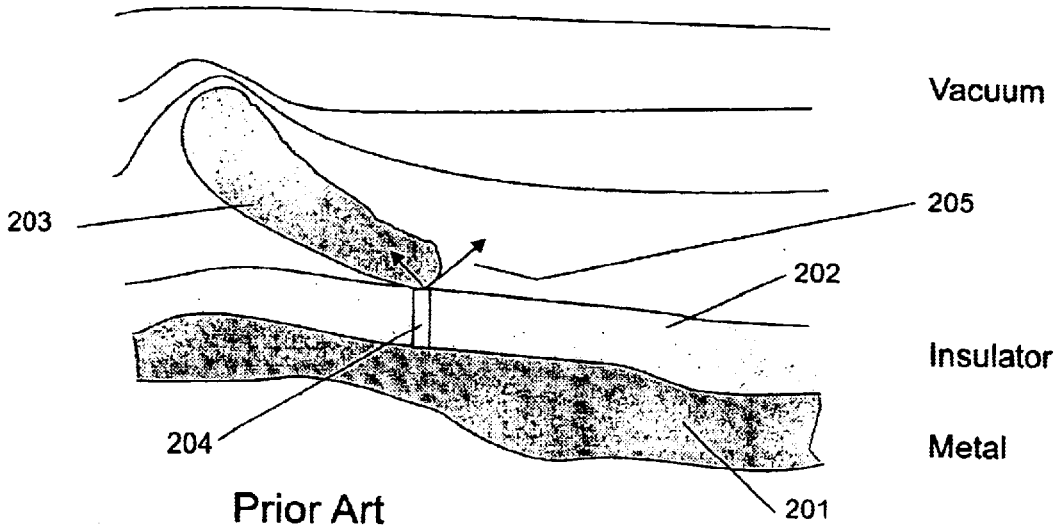
Prior Art Figure 1a
FIG. 1*a* illustrates a known emission mechanism in which a conducting flake sits on an insulating layer.
Figure 1B:
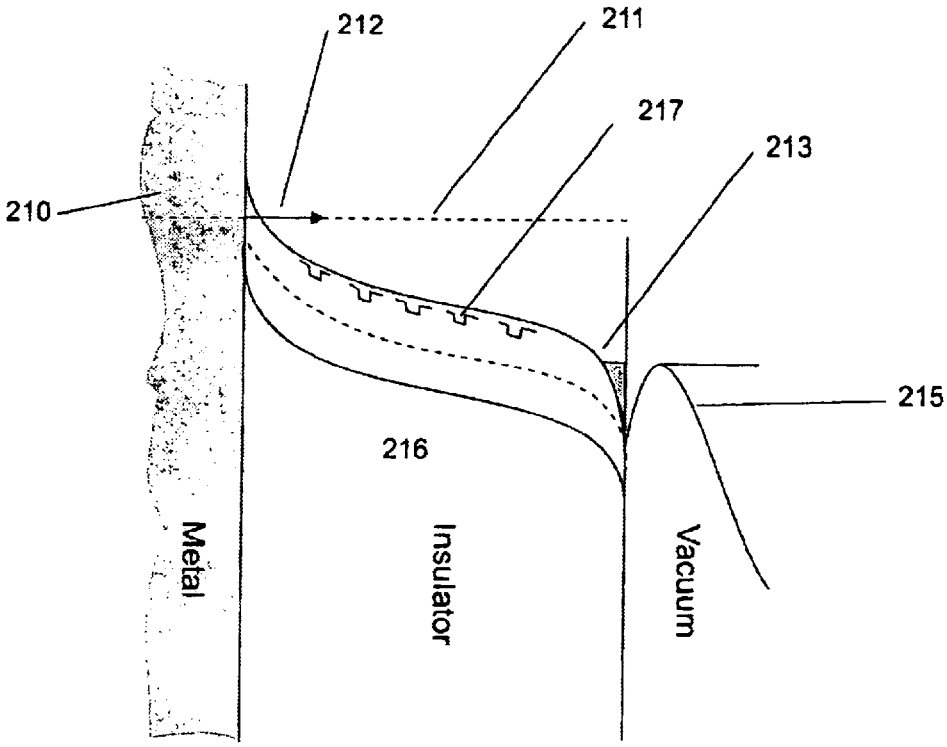
FIG. 1*b* is a proposed energy level diagram for an electro-formed conducting channel in the insulating layer of FIG. 1*a;*
Figure 2A:
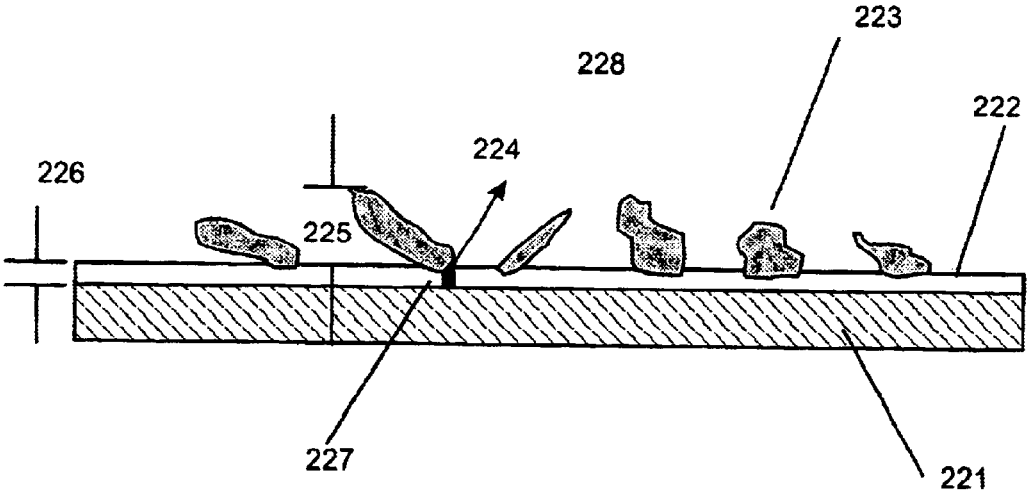
FIG. 2*a* and 2*b* show respective examples of improved field electron emission materials.

FIG. 2*a* shows one embodiment of an improved material with conducting particles 223 disposed upon an insulating layer 222 on a substrate 221. Following the formation of electro-formed channels as described above with reference to FIGS. 1*a* and 1*b,* electrons 224 are emitted from the bases of the particles 223 into medium 228 (often a vacuum). This arrangement produces a material that can supply a significantly higher current, before channel heating causes instability or failure, than previously known materials. Preferably the insulator is inorganic, which eliminates high vapour pressure materials, enabling the material to be used in sealed-off vacuum devices. For insulating substrates, a conducting layer is applied before coating. The conducting layer may be applied by a variety of means including, but not limited to, vacuum and plasma coating, electro-plating, electroless plating and ink based methods such as the resinate gold and platinum systems routinely used to decorate porcelain and glassware.

The standing electric field required to switch on the electro-formed channels is determined by the ratio of particle height 225 (as measured substantially normal to the surface of the insulating layer 222) and the thickness 226 of the insulator in the region of the conducting channels 227. For a minimum switch on field, the thickness of the insulator at the conducting channels should be significantly less than the particle height. The conducting particles 223 would typically be in, although not restricted to, the range 0.1 $\mu$m to 400 $\mu$m, preferably with a narrow size distribution.

Figure 2B:
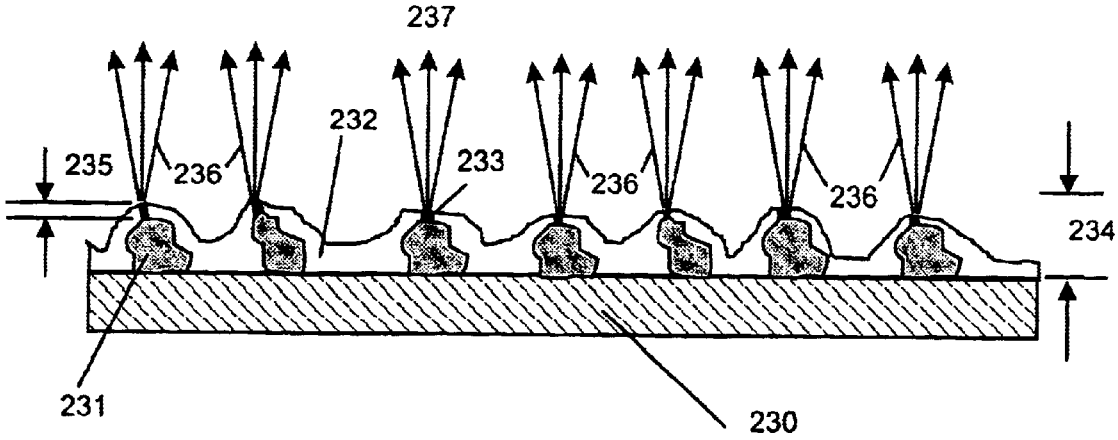

FIG. 2*b* shows another embodiment of improved material in which particles 231 are in electrical contact with conducting substrate 230 and coated with a layer of insulator 232. The thickness 235 of insulator layer at the upper extremity of each particle 231 is thin relative to the particle height 234 normal to the surface. On application of a suitable electric field conducting channels 233 form at the positions of maximum field enhancement. Electrons 236 are then emitted into the medium 237.

Figure 3:
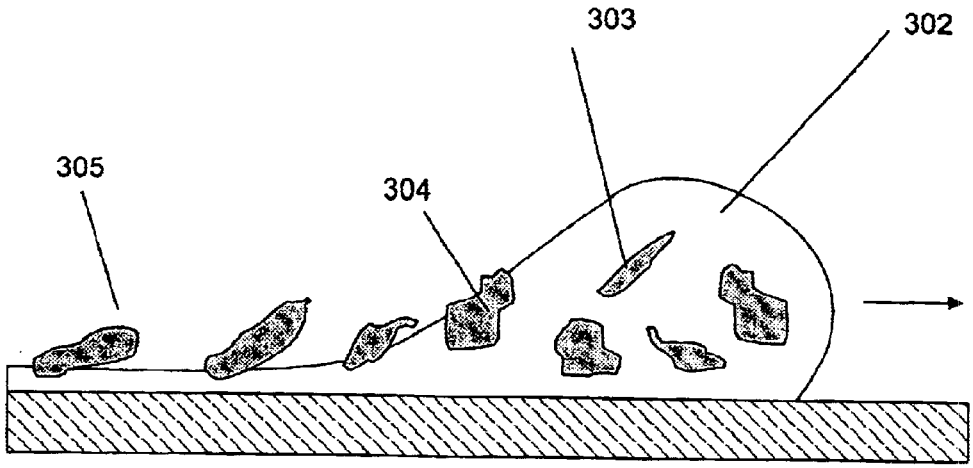
FIG. 3 illustrates a coating process, such as spin or blade coating, from an ink in which the particles are exposed at the surface.

With reference to FIG. 3, structures of the kind illustrated in FIG. 2*a* may be produced by a flow coating process (e.g. spin coating) where a fluid medium 302 contains an insulating material and conducting or semi-conducting particles 303 that due to their natural properties or surface coatings (sometimes temporary) do not wet the solution or dispersion containing the insulator and are exposed 304 as part of the coating process to form the desired structures 305. Table coating may be employed, using for example equipment such as that manufactured by Chungai Ro Co. Ltd of Japan.

Examples of suitable insulating materials are: glasses, glass ceramics, polysiloxane and similar spin on glass materials heated to reduce the organic content or form inorganic end products such as silica, ceramics, oxide ceramics, oxides, nitrides, borides, diamond, polymers or resins.

Examples of suitable particles are: metals and other conductors, semiconductors, graphite, silicon carbide, tantalum carbide, hafnium carbide, zirconium carbide, boron carbide, titanium diboride, titanium carbide, titanium carbonitride, the Magneli sub-oxides of titanium, semi-conducting silicon, III–V compounds and II–VI compounds.

One suitable dispersion can be formulated from a mixture of a spin-on glass material and particles. Said particles may be pre-treated to control wetting and would optionally have a narrow size distribution. Such spin-on glass materials are typically based on polysiloxanes and are used extensively in the semiconductor industry. However, spin-on glasses based upon other chemical compounds may be used. Following coating the layers are heated to reduce the organic content or form inorganic end products such as silica.

It has been noted that it is preferable that the particles within the dispersion have a narrow size range. The critical issue is in fact to eliminate the larger particles from the mix since they form a small number of field emission sites that turn-on at low fields. Because of the nature of field emission, these few sites then emit the majority of the current up to the point at which they fail thermally. A large number of less emissive sites is preferable for device applications. Classifying powders to completely remove the large fraction is difficult, especially in the size range of interest. Sieving is slow and air classification does not have a sharp cut-off.

Figure 15:
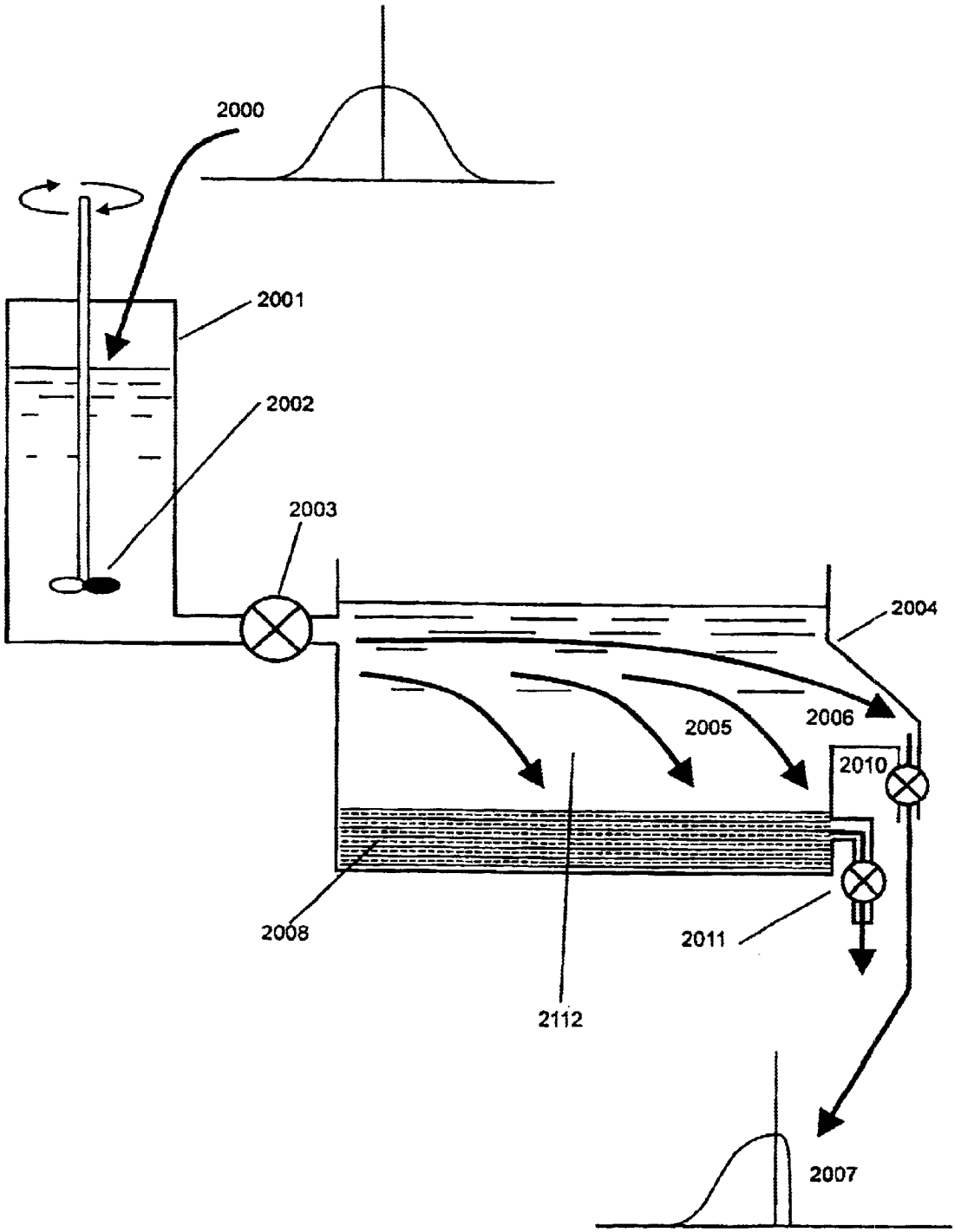
FIG. 15 shows an apparatus for removing large particles from field emitter ink dispersions.

Sedimentation in a liquid medium is a useful technique but recovering the particles by drying can lead to agglomerates which behave as large particles. FIG. 15 shows a process using sedimentation that avoids these problems. The feed stock 2000 is either:

- the liquid insulator layer precursor such as polysiloxane spin on glass;
- or the vehicle that will be used to form a subsequent dispersion of, for example glass fritt, together with the un-classified particles.

The mixture is added to tank 2001 where it is kept agitated by stirrer 2002. The mixture is passed to tank 2004 via a metering valve or pump 2003 which adds liquid at a rate that maintains a slow horizontal passage of the suspension across the settling region 2112. Valve 2010 is adjusted to maintain the level in tank 2004. The larger particles 2005 settle out to the bottom of the tank 2008 where they may be periodically removed via valve 2011. The classified suspension 2006 passes out of valve 2010 and now contains particles with a high diameter cut-off 2007. In addition to its application in this embodiment of the invention, this process may be used for any particle-based field emitter systems e.g. MIMIV materials such as those described by Tuck, Taylor and Latham (GB 2304989). Clearly other arrangements for either continuous or batch processing of dispersions in the host vehicle may be devised by those skilled in the art.

Figure 4:
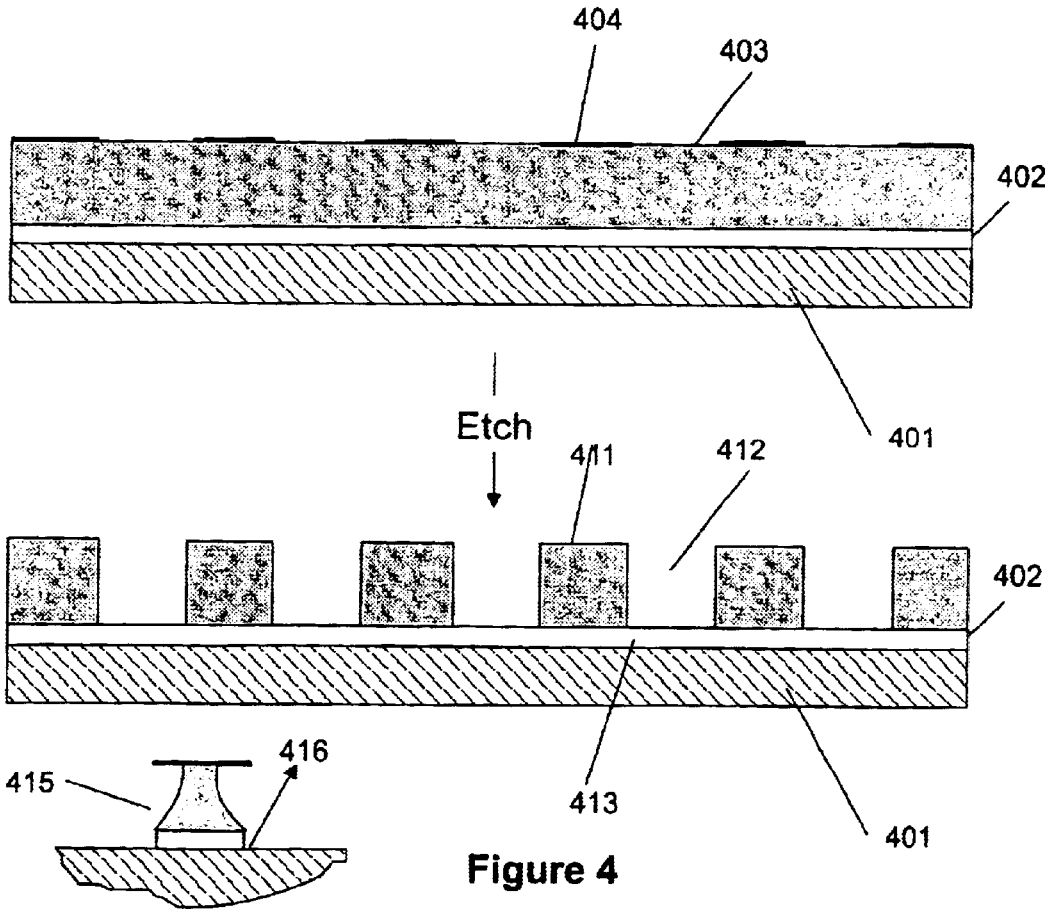
FIG. 4 illustrates a process of forming particles from a previously continuous film.

FIG. 4 shows an alternative method of making an emitter in which a conducting substrate 401 has a layer of insulator 402 and conductor 403 deposited upon it. Using, for example, a patterned resist layer 404, the conducting material 402 is selectively etched 412 to leave fabricated particle analogues 411. In some cases it may be advantageous to also remove the portions 413 of insulating layer from between the particle analogues. The natural tendency for etching to form undercuts 415 below the resist pattern 404 facilitates the exit of electrons 416 from the electro-formed channel at the base of the structure. Said structures may be also constructed using the well established techniques of semiconductor fabrication. For example the insulating layer 402 may be formed by oxidising an otherwise conducting wafer and then metallised. A similar approach may be used to form the structures illustrated in FIG. 2*b*.

Figure 5:
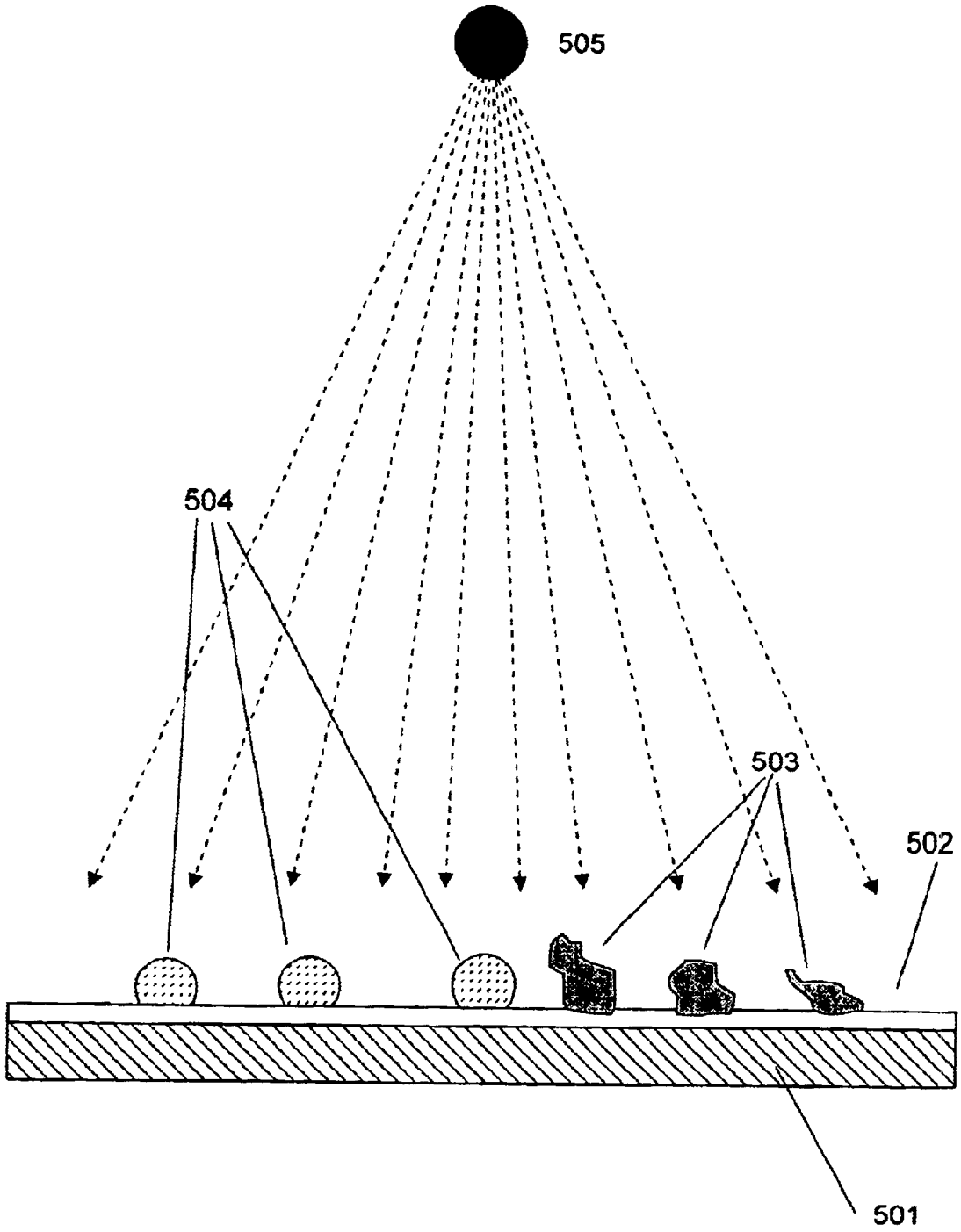
FIG. 5 illustrates the forming of a particle layer by a spraying processes.

FIG. 5 show another way of making such emitters using spraying techniques.

In the case of the structures illustrated in FIG. 2*a* a conducting substrate 501 with an insulating layer 502 has particles deposited from a spray source 505. Said insulating layer may be formed itself by a spraying process.

In the case of the structures illustrated in FIG. 2*b* the spraying takes place directly onto a conducting substrate. An insulating layer consisting of a polysiloxane spin on glass or a dispersion of a glass fritt in a suitable binder may then be be applied using techniques such as spin or table coating. The layer will be subsequently fired to convert the polysiloxane to silica or to fuse the glass fritt. Clearly other techniques may be used.

There are two main variations of the spraying method.

1. The flux of particles 503 may impinge on the surface as a solid with or without a liquid vehicle followed by subsequent bonding to the surface: for example by a brazing, a fritting process, or the melting of the metal or insulator film. A traditional spray gun or electrostatic spraying system may be used.

2. A flux of particles 504 may impinge on the surface with sufficient kinetic energy to form a bond or may be molten at the moment of impact. Such conditions may, for example, be achieved using flame or plasma spraying.

Figure 6:
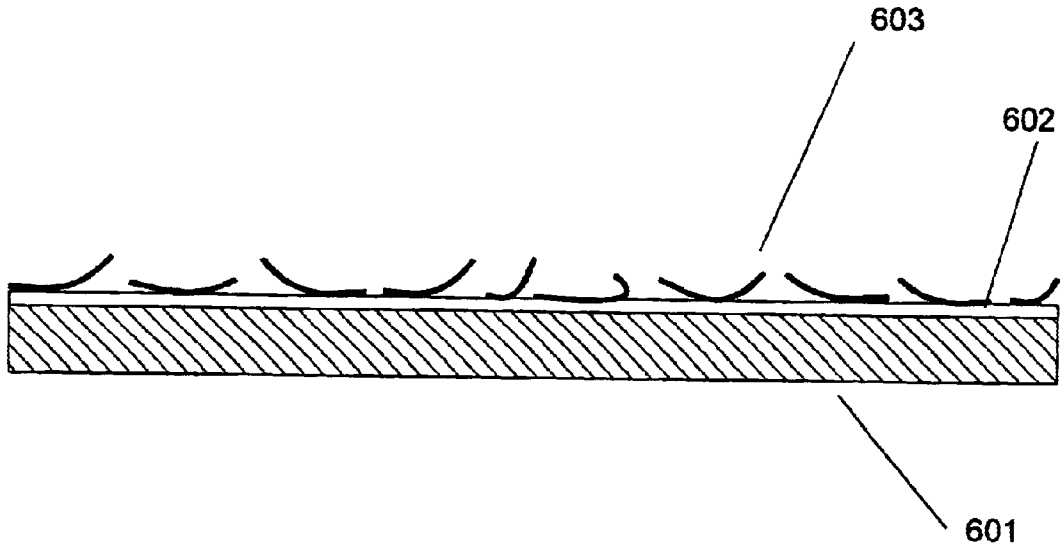
FIG. 6 illustrates the forming of conductive flakes by the cracking of a previously continuous film.

FIG. 6 illustrates a further method of forming an emitter in which a conducting substrate 601 has an insulating layer 602 and a deposited thin film of conductor 603. The deposition conditions of said film 603 are controlled such that there is sufficient residual stress in the as-deposited film to cause it to craze or crack and relieve said stress by flexing to form electrically isolated flakes that are partially raised from the surface. For example thin films deposited by vacuum evaporation and sputter coating can be made to fulfil these criteria.

In all the above-described embodiments of the invention, there is an optimum density of conducting particles that prevents the nearest-neighbour particles screening the electric field at the base of a given particle. For spherical particles, the optimum particle-to-particle spacing is approximately 1.8 times the particle diameter.

To facilitate even switch-on of emitting sites, symmetrical particles, such as those of a rough hewn cuboid shape are preferred.

Alternatively, precision fibres, such as carbon fibre or fine wire, may be chopped into lengths somewhat longer than their diameter. The tendency of these fibre segments will be to lie down (especially during spin coating) with the fibre axis parallel to the substrate such that the diameter of the fibre determines the antenna effect.

Particles of the correct morphology (e.g. glass microspheres) but not composition may be over coated with a suitable material by a wide range of processes including sputtering.

A primary purpose of preferred embodiments of the invention is to produce emitting materials with low cost and high manufacturability. However, for less cost-sensitive applications, the very high thermal conductivity that may be achieved means that intentionally engineered structures, using diamond as the insulator, can provide materials that can deliver the highest mean currents before catastrophic failure of the electro-formed channels.

Figure 7:
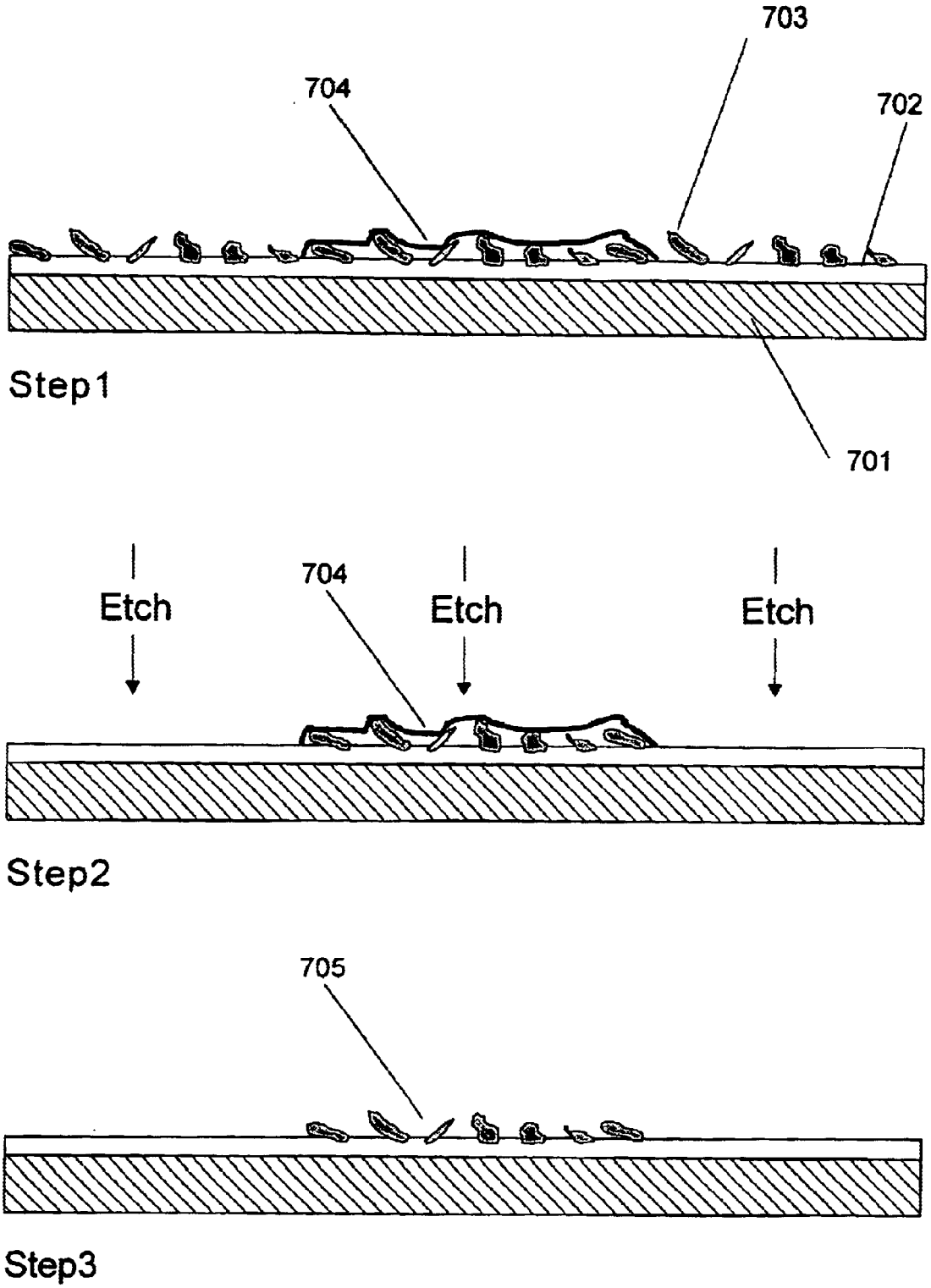
FIG. 7 illustrates a process in which selected areas of an emitter may be deactivated by masking and etching.

FIG. 7 shows a useful process in which Step 1 a substrate 701 with insulator 702 and particles 703 has an area masked by a resist coating 704. In Step 2 a selective etch is used to remove the particles. In Step 3 the resist is removed to leave the masked areas 705 with field emitting properties.

Figure 8:
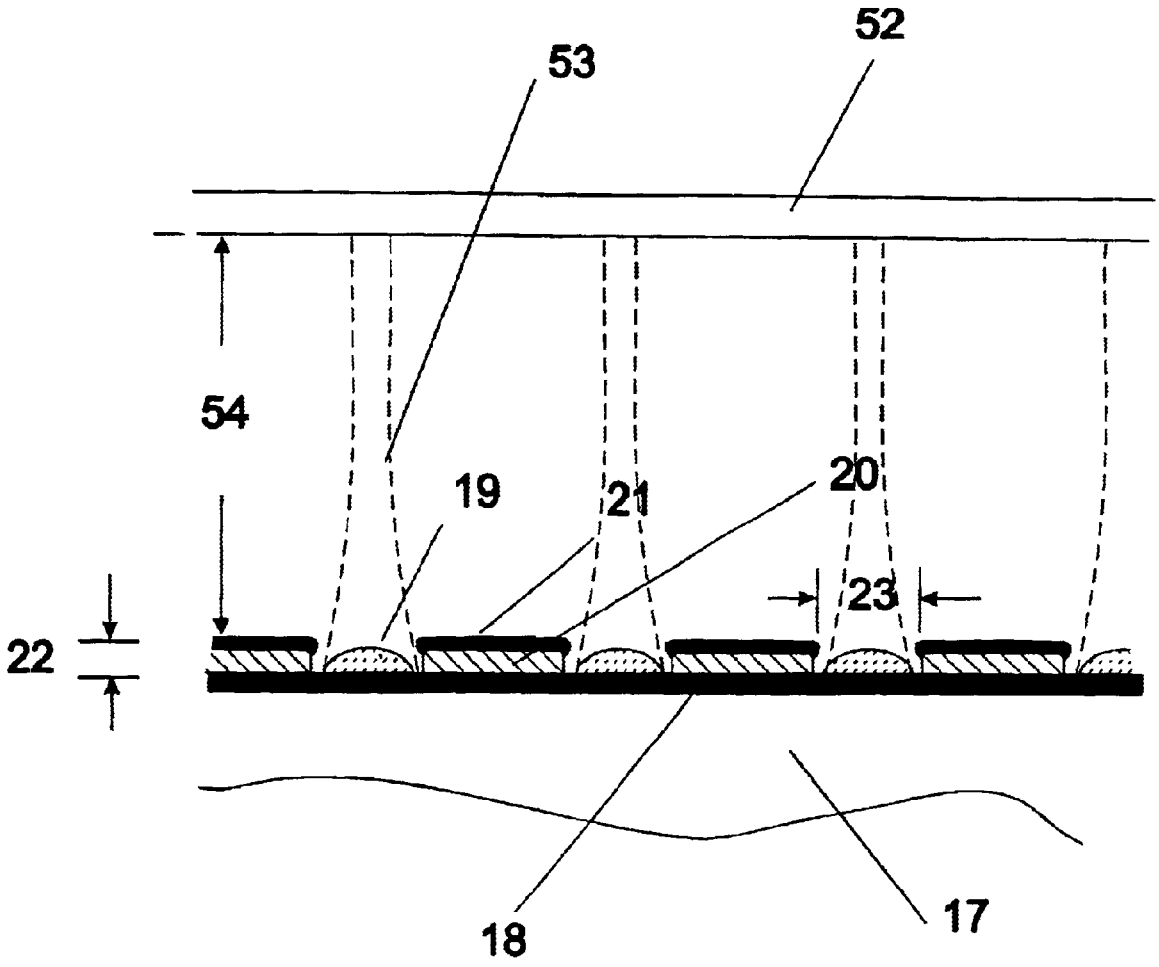
FIG. 8 illustrates a gated field emission device using improved material.

FIG. 8 shows a gated array using an improved field electron emission material—for example, one of the materials as described above. Emitter patches 19 are formed on a substrate 17 on which a conducting layer 18 is deposited, if required, by a process such as vacuum coating or non-vacuum technique. A perforated control or gate electrode 21 is insulated from the substrate 17 by a layer 20. Typical dimensions are emitter patch diameter (23) 10 $\mu$m; gate electrode-substrate separation (22) 5 $\mu$m. A positive voltage on the gate electrode 21 controls the extraction of electrons from the emitter patches 19. The electrons 53 are then accelerated into the device 52 by a higher voltage 54. The field electron emission current may be used in a wide range of devices including: field electron emission display panels; high power pulse devices such as electron MASERS and gyrotrons; crossed-field microwave tubes such as CFAs; linear beam tubes such as klystrons; flash x-ray tubes;

triggered spark gaps and related devices; broad area x-ray sources for sterilisation; vacuum gauges; ion thrusters for space vehicles and particle accelerators.

Figure 9A:
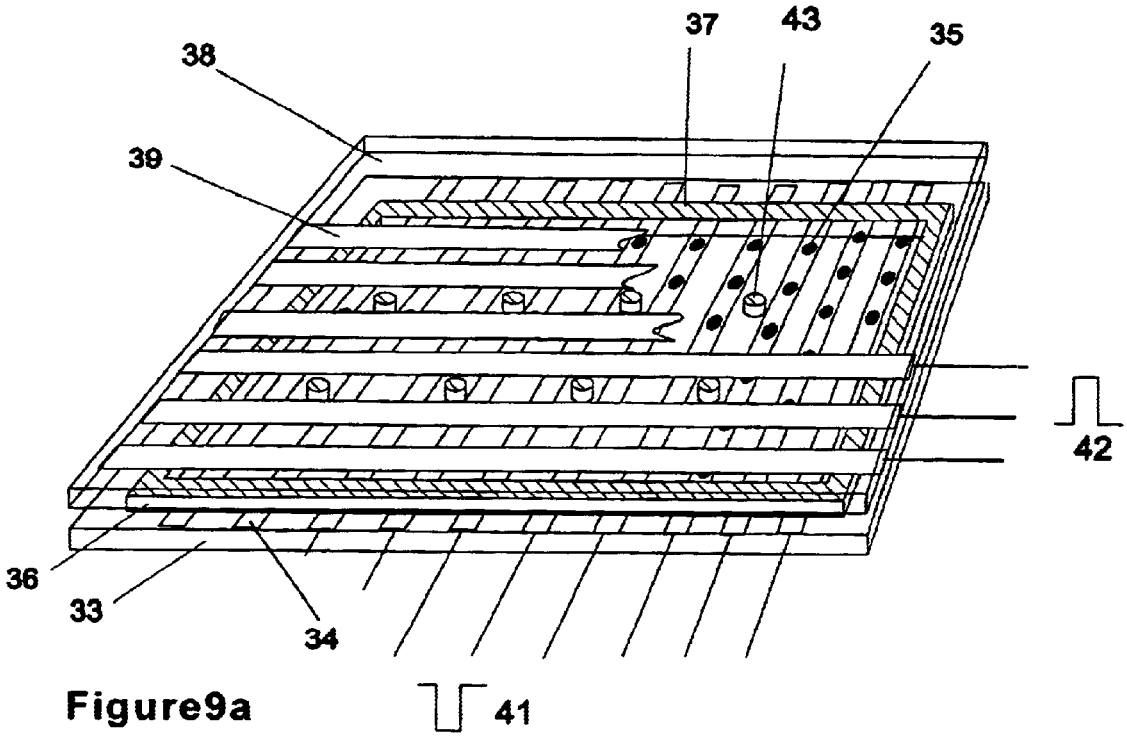
FIG. 9*a* shows a field electron emission display using improved field electron emission material.

FIG. 9*a* shows a field emission display based upon a diode arrangement using one of the above-described materials—e.g. the material of FIG. 2. A substrate 33 has conducting tracks 34 which carry emitting patches 35 of the material. A front plate 38 has transparent conducting tracks 39 running across the tracks 34. The tracks 39 have phosphor patches or stripes. The two plates are separated by an outer ring 36 and spacers 43. The structure is sealed by a material 37 such as a solder glass. The device is evacuated either through a pumping tube or by fusing the solder glass in a vacuum furnace.

Pixels are addressed by voltages 41, 42 applied in a crossbar fashion. The field emitted electrons excite the phosphor patches. A drive system consisting of positive and negative going waveforms both reduces the peak voltage rating for the semiconductors in the drive electronics, and ensures that adjacent pixels are not excited. Further reductions in the voltage swing needed to turn pixels on can be achieved by DC biasing each electrode to a value just below that at which the field electron emission current becomes significant. A pulse waveform is then superimposed on the DC bias to turn each pixel on: voltage excursions are then within the capability of semiconductor devices.

Figure 11:
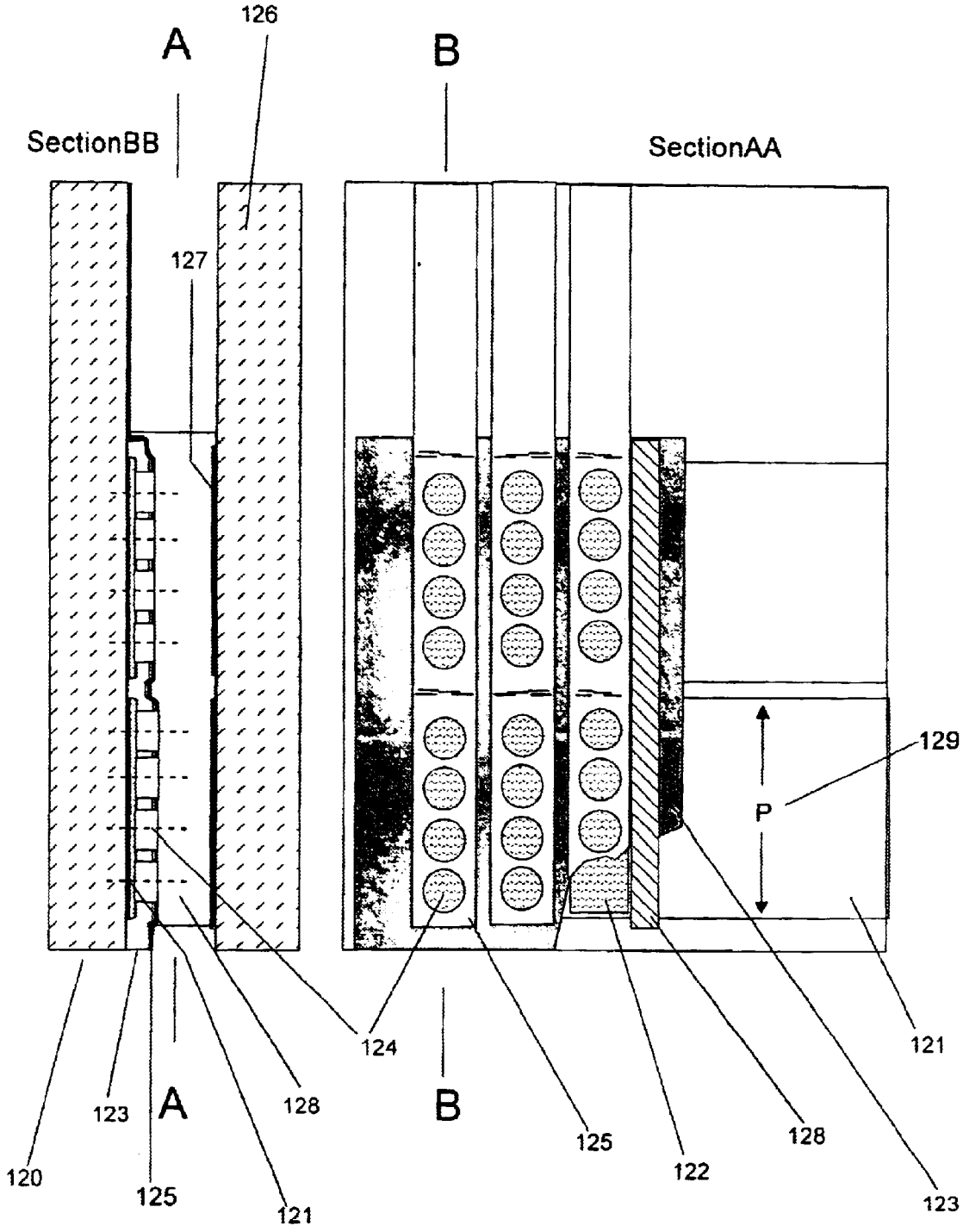
FIG. 11 shows two pixels in a colour display, utilising a triode system with a control electrode.

An alternative approach to the diode arrangement is to utilise a triode system with a control electrode. FIG. 11, which depicts two pixels in a colour display, shows one embodiment of this approach. For pictorial simplicity only two pixels are shown. However the basic structure shown may be scaled up to produce large displays with many pixels. A cathode substrate 120 has conducting tracks 121 coated onto its surface to address each line in the display. Such tracks may be deposited by vacuum coating techniques coupled with standard lithographic techniques well known to those skilled in the art; by printing using a conducting ink; or many other suitable techniques. Patches 122 of an emitting material (eg as described above) are disposed, using the methods described previously, onto the surface of the tracks to define sub-pixels in a Red-Green-Blue triad. Dimension "P" 129 is typically in, although not limited to, the range 200 $\mu$m (micrometer) to 700 $\mu$m. Alternatively, although less desirable, the emitting material may be coated over the whole display area. An insulating layer 123 is formed on top of the conducting tracks 121. The insulating layer 123 is perforated with one or more apertures per pixel 124 to expose the emitting material surface, such apertures being created by printing or other lithographic technique. Conducting tracks 125 are formed on the surface of the insulator to define a grid electrode for each line in the colour triad. The dimensions of the apertures 124 and the thickness of the insulator 123 are chosen to produce the desired value of transconductance for the triode system so produced. The anode plate 126 of the display is supported on insulating spacers 128. Such spacers may be formed on the surface by printing or may be prefabricated and placed in position. For mechanical stability, said prefabricated spacers may be made in the form of a cross-shaped structure. A gap filling material, such as a glass fritt, may be used to fix both the spacer in position at each end and to compensate for any dimensional irregularities. Red, green and blue phosphor patches or stripes 127 are disposed on the inside surface of the anode plate. The phosphors are either coated with a thin conducting film as is usual in cathode ray tubes or, for lower accelerating voltages, the inside of the anode plate has deposited on it a transparent conducting layer such as, but not limited to, indium tin oxide. The interspace between the cathode and anode plates is evacuated and sealed.

The reader is directed to our copending application GB 97 22258.2 for further details of constructing Field Effect Devices, in which embodiments of the present invention may be employed.

A DC bias is applied between conducting strips 121 and the conducting film on the anode. The electric field so produced penetrates through the grid apertures 124 and releases electrons from the surface by field emission from the MIV field emission process described earlier. The DC voltage is set lower than required for full emission thus enabling a line to be addressed by pulsing one of the tracks 121 negative with respect to the others to a value that gives the current for peak brightness. The grid tracks 125 are biased negative with respect to the emitter material to reduce the current to its minimum level when the tracks 121 are in their negative pulsed (line addressed) state. During the line period all grid tracks are pulsed positively up to a value that gives the desired current and hence pixel brightness. Clearly other driving schemes may be used.

To minimise the cost of the drive electronics, gate voltage swings of a few tens of volts are needed. To meet this specification, the apertures in the gate electrode structures shown in FIG. 11 become quite small. With circular apertures, this results in many emitting cells per sub-pixel. An alternative arrangement for such small structures is to elongate the small emitting cells into slots.

Figure 14:
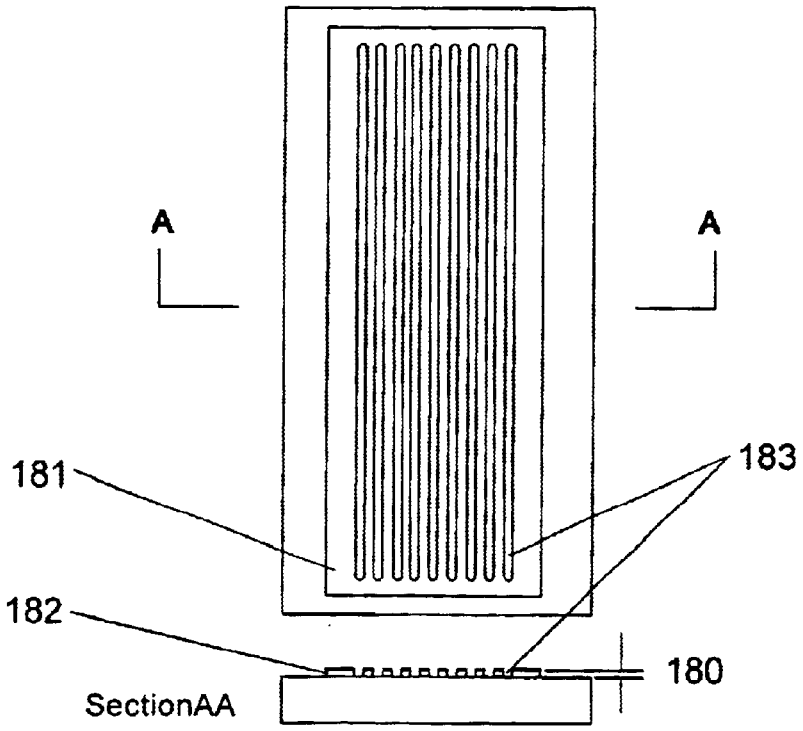
FIG. 14 shows a sub-pixel of an electrode system, where gate to emitter spacing has been reduced.

FIG. 14 shows one sub-pixel of such an electrode system, where the gate to emitter spacing 180 has been reduced to a few micrometres. The gate 181 and insulator layer 182 have slots 183 in them, exposing the emitting material.

Although a colour display has been described, it will be understood by those skilled in the art that an arrangement without the three-part pixel may be used to produce a monochrome display.

To ensure a long life and stable operating characteristics a high vacuum must be maintained in the device. It has been normal in the art of electron tubes to use getters to adsorb gas desorped from the walls and other internal structures. One location for gettering materials in field emitting displays is around the perimeter of the display panel on those sides where there are no electrical feedthroughs. It is well known to those skilled in the art that this location becomes far from ideal as the panel size increases. This is because of the low gas flow conductance between the centre and the edge of the panel that results from the long distances and sub-millimetre clearances between the panels. Calculations show that for panels greater than a 250 mm diagonal dimension this conductance drops to a level where the getter system becomes ineffective. U.S. Pat. No. 5,223,766 describes two methods of overcoming this problem. One method involves a cathode plate with an array of holes leading into a back chamber with larger clearances and distributed getters. The other method is to make the gate electrode of a bulk gettering material such as zirconium. Although both methods work in principle there are distinct practical problems with them.

In the perforated cathode plate approach, the perforations in the cathode plate must be small enough to fit within the spaces between the pixels. To avoid visible artefacts this limits their diameter to a maximum of 125 micrometers for television and rather less for computer workstations. The cost of drilling millions of ~100 micrometers holes in 1 mm to 2 mm thick glass, the obvious material for the cathode plate, is likely to be prohibitive. Furthermore, the resulting component will be extremely fragile: a problem that will increase with increasing panel dimensions.

In order to be effective at room temperature, bulk getters must have a very high surface area. This is usually achieved by forming a sintered particulate layer. The gate electrode in a field emitting display sits in a strong accelerating DC field. It is clear from the field emitter systems described herein that such particulate getter layers are likely to provide a significant number of field emitting sites. Such sites will emit electrons continuously exciting one or more of the phosphor patches in the vicinity to produce a visible defect in the display.

Figure 12:
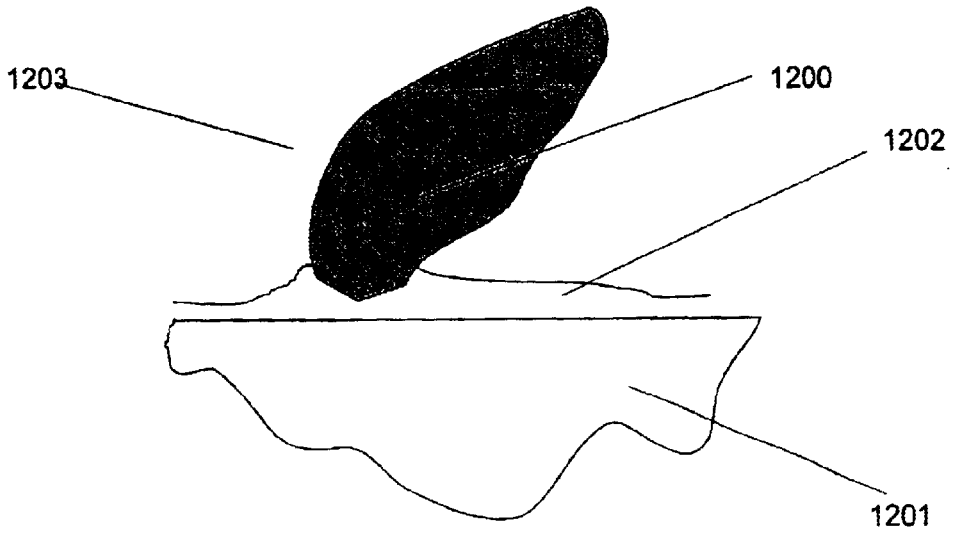
FIG. 12 shows an emitter material in which particles are of an active gettering material.

Turning now to the displays shown in FIGS. 9 and 11 a distributed getter system may be incorporated into the emitter structure by using an active particle, or cluster of particles to make the MIV emitter as described above. FIG. 12 shows one embodiment where a particle 1200 is fixed to a substrate 1201 by an insulating material 1202. The composition of the insulating material 1202 may be as described above. This arrangement leaves an area of exposed gettering material 1203. Suitable particle materials for gettering materials are finely divided Group IVa metals such as Zirconium, Tantalum and proprietary gettering alloys (for example Zr—Al) such as those produced by SAES Getters of Milan.

Figure 9B:
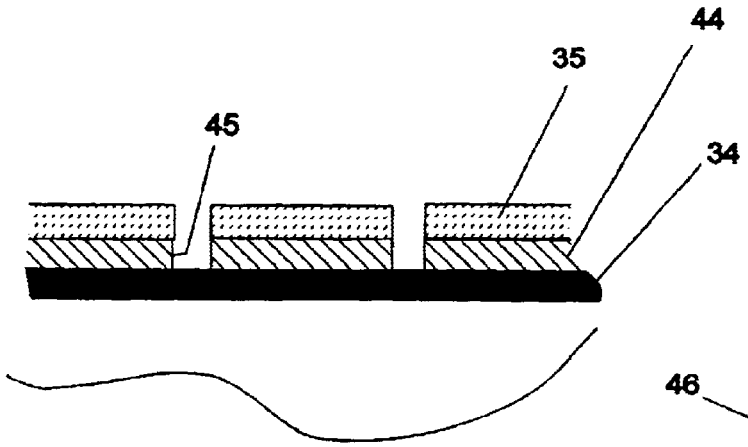
FIGS. 9*b* and 9*c* are detail views showing modifications of parts of the display of FIG. 9*a;*
Figure 9C:
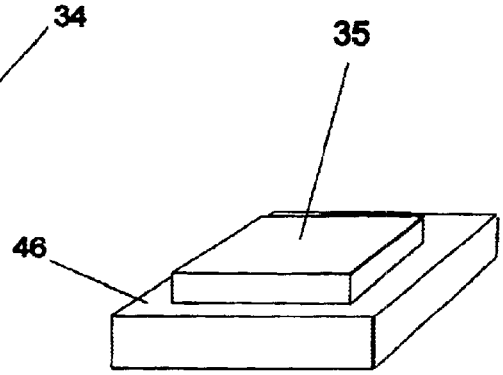

A problem with all field electron emission displays is in achieving uniform electrical characteristics from pixel to pixel. One approach is to use electronics that drive the pixels in a constant current mode. An alternative approach that achieves substantially the same objective is to insert a resistor of appropriate value between the emitter and a constant voltage drive circuit. This may be external to the device. However, in this arrangement, the time constant of the resistor and the capacitance of the conducting track array places a limit on the rate that pixels can be addressed. Forming the resistor in situ between the emitter patch and the conducting track enables low impedance electronics to be used to rapidly charge the track capacitance, giving a much shorter rise time. Such an in situ resistive pad 44 is shown in FIG. 9*b*. The resistive pad may be screen printed onto the conducting track 34, although other coating methods may be used. In some embodiments, the voltage drop across the resistive pad 44 may be sufficient to cause voltage breakdown across its surface 45. To prevent breakdown, an oversize resistive pad 46 may be used to increase the tracking distance, as illustrated in FIG. 9*c*.

Figure 10A:
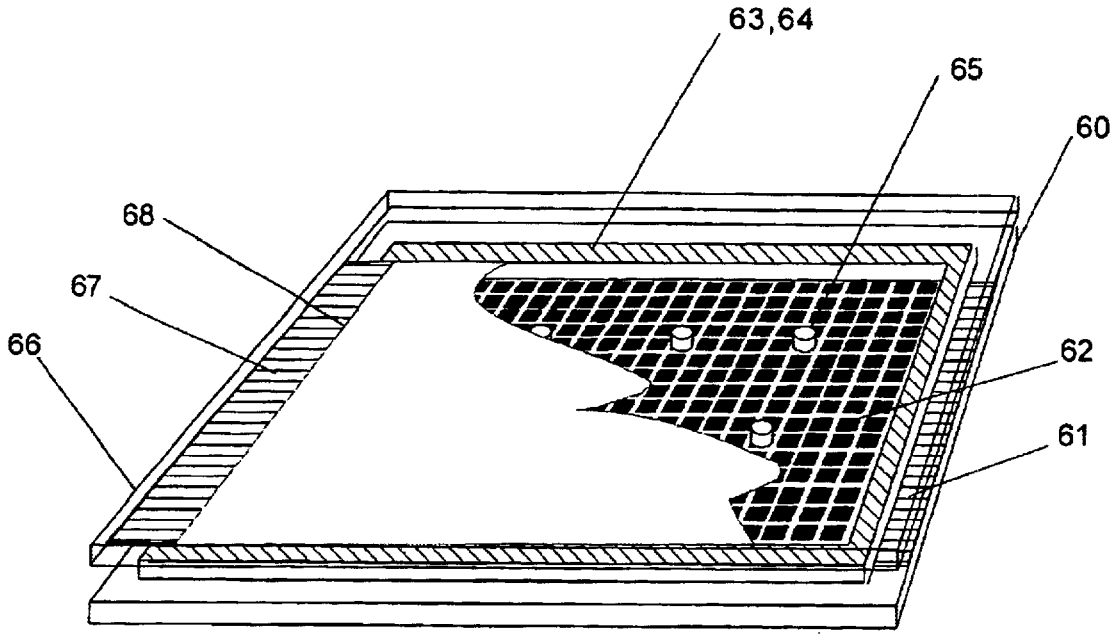
FIG. 10*a* shows a flat lamp using an improved field electron emission material and FIG. 10*b* shows a detail thereof.

FIG. 10*a*shows a flat lamp using one of the above-described materials. Such a lamp may be used to provide backlighting for liquid crystal displays, although this does not preclude other uses such as room lighting.

Figure 10B:
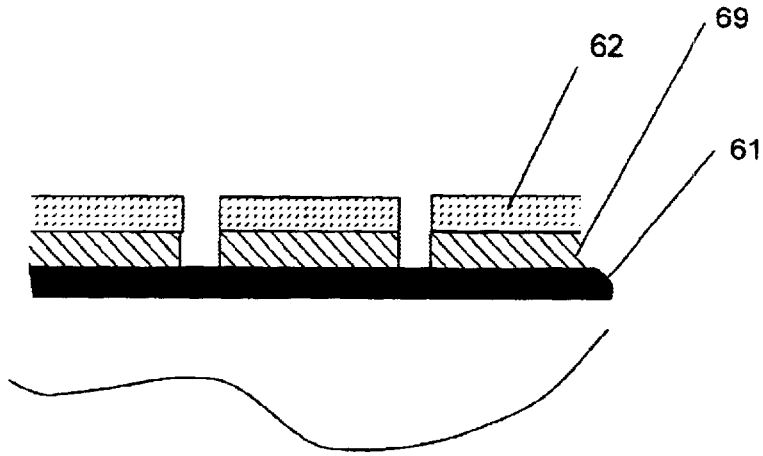

The lamp comprises a back plate 60 which may be made of a metal that is expansion matched to a light transmitting front plate 66. If the back plate is an insulator, then a conducting layer 61 is applied. The emitting material 62 (eg as above) is applied in patches. To force the system towards equal field emitted current per emitting patch, and hence produce a uniform light source, each patch is electrically connected to the back plate via a resistor. Such a resistor can be readily formed by an electrically resistive pad 69, as shown in FIG. 10*b*. As in FIG. 9*c*, the resistive pad may have a larger area than the emitting patch, to inhibit voltage breakdown across its thickness. The front plate 66 has a transparent conducting layer 67 and is coated with a suitable phosphor 68. The two plates are separated by an outer ring 63 and spacers 65. The structure is sealed by a material 64 such as a solder glass. The device is evacuated either through a pumping tube or by fusing the solder glass in a vacuum furnace. A DC voltage of a few kilovolts is applied between the back plate 60 or the conducting layer 61 and the transparent conducting coating 67. Field emitted electrons bombard the phosphor 68 and produce light. The intensity of the lamp may be adjusted by varying the applied voltage.

For some applications, the lamp may be constructed with addressable phosphor stripes and associated electronics to provide a scanning line in a way that is analogous to a flying spot scanner. Such a device may be incorporated into a hybrid display system.

Figure 13:
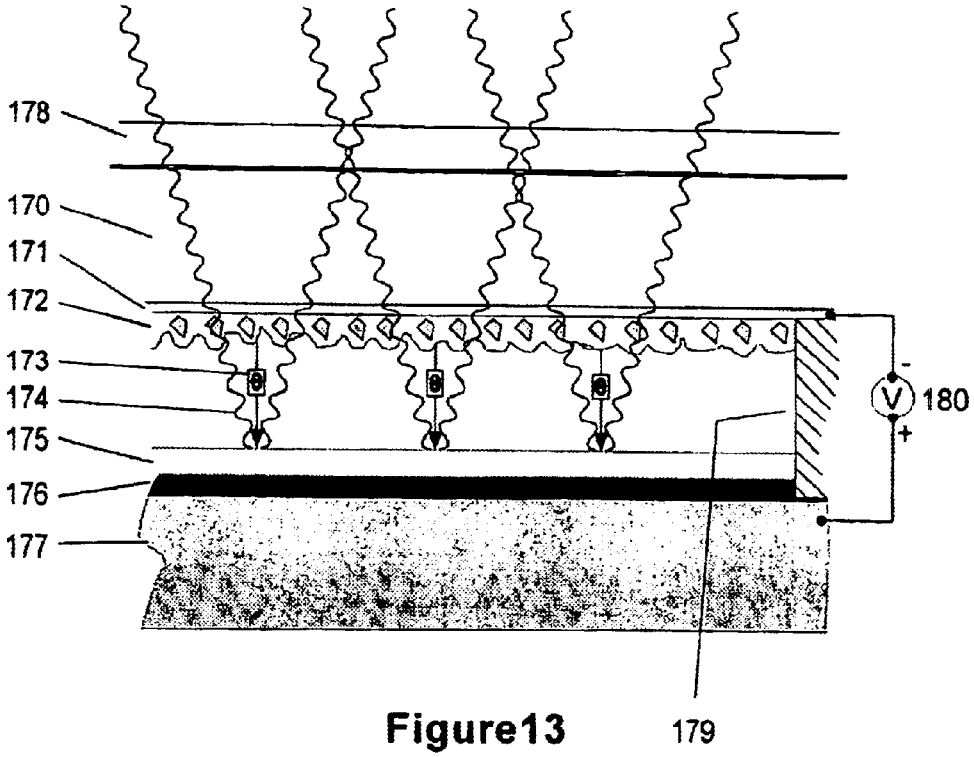
FIG. 13 illustrates a high conversion efficiency field emission lamp with light output through an emitter layer.

Although field emission cathodoluminescent lamps as described above offer many advantages over those using mercury vapour (such as cool operation and instant start), they are intrinsically less efficient. One reason for this is the limited penetration of the incident electrons into the phosphor grains compared with that for ultraviolet light from a mercury discharge. As a result, with a rear electron excited phosphor, much of the light produced is scattered and attenuated in its passage through the particles. If light output can be taken from the phosphor on the same side onto which the electron beam impinges, the luminous efficiency may be approximately doubled. FIG. 13 shows an arrangement that enables this to be achieved.

In FIG. 13 a glass plate 170 has an optically transparent electrically conducting coating 171 (for example, tin oxide) onto which is formed a layer of MIV emitter 172 as described herein. This emitter is formulated to be substantially optically translucent and, being comprised of randomly spaced particles, does not usffer from the Moire patterning that the interference between a regular tip array and the pixel array of the LCD would produce. Such a layer may be formed with, although not limited to, a heat cured polysiloxane based spin-on glass as the insulating component. The coated cathode plate described above is supported above an anode plate by spacers 179 and the structure sealed and evacuated in the same manner as the lamp shown in FIG. 10*a*. The anode plate 177 which may be of glass, ceramic, metal or other suitable material has disposed upon it a layer of electroluminescent phosphor 175 with an optional reflective layer 176, such as aluminum, between the phosphor and the anode plate. A voltage 180 in the kilovolt range is applied between the conducting layer 171 and the anode plate 177 (or in the case of insulating materials a conducting coating thereon). Field emitted electrons 173 caused by said applied voltage are accelerated to the phosphor 175. The resulting light output 174 passes through the translucent emitter 172 and transparent conducting layer 171. An optional Lambertian or non-Lambertian diffuser 178 may be disposed in the optical path. Similar approached may be used to increase the luminance of addressable displays.

Embodiments of the invention may employ thin-film diamond with graphite surface particulates that are optimised to meet the requirements of the invention—for example, by aligning such particulates, making them of sufficient size and density, etc. In the manufacture of thin-film diamond, the trend in the art has been emphatically to minimise graphite inclusions, whereas, in appropriate embodiments of the invention, such surface particulates are deliberately included and carefully engineered.

An important feature of preferred embodiments of the invention is the ability to print an emitting pattern, thus enabling complex multi-emitter patterns, such as those required for displays, to be created at modest cost. Furthermore, the ability to print enables low-cost substrate materials, such as glass to be used; whereas micro-engineered structures are typically built on high-cost single crystal substrates. In the context of this specification, printing means a process that places or forms an emitting material in a defined pattern. Examples of suitable processes are: screen printing, Xerography, photolithography, electrostatic deposition, spraying or offset lithography.

Devices that embody the invention may be made in all sizes, large and small. This applies especially to displays, which may range from a single pixel device to a multi-pixel device, from miniature to macro-size displays.

In this specification, by a "channel" or "conducting channel", we mean a region of an insulator where its; properties have been locally modified—for example, by some forming process. In the example of a conductor-insulator-vacuum (e.g. MIV) structure, such a modification facilitates the transport of electrons from the back contact (between conductor/electrode and insulator), through the insulator into the vacuum. In the example of a conductor-insulator-conductor (e.g. MIM) structure, requirements of the invention—for example, by aligning such particulates, making them of sufficient size and density, etc. In the manufacture of thin-film diamond, the trend in the art has been emphatically to minimise graphite inclusions, whereas, in appropriate embodiments of the invention, such surface particulates are deliberately included and carefully engineered.

An important feature of some embodiments of the invention is the ability to print an emitting pattern, thus enabling complex multi-emitter patterns, such as those required for displays, to be created at modest cost. Furthermore, the ability to print enables low-cost substrate materials, such as glass to be used; whereas micro-engineered structures are typically built on high-cost single crystal substrates. In the context of this specification, printing means a process that places or forms an emitting material in a defined pattern. Examples of suitable processes are: screen printing, Xerography, photolithography, electrostatic deposition, spraying or offset lithography.

Devices that embody the invention may be made in all sizes, large and small. This applies especially to displays, which may range from a single pixel device to a multi-pixel device, from miniature to macro-size displays.

In this specification, by a "channel" or "conducting channel", we mean a region of an insulator where its properties have been locally modified—for example, by some forming process. In the example of a conductor-insulator-vacuum (e.g. MIV) structure, such a modification facilitates the transport of electrons from the back contact (between conductor/electrode and insulator), through the insulator into the vacuum. In the example of a conductor-insulator-conductor (e.g. MIM) structure, such a modification facilitates the transport of electrons from the back contact, through the insulator to the other conductor/electrode.

In this specification, the verb "comprise" has its normal dictionary meaning, to denote non-exclusive inclusion. That is, use of the word "comprise" (or any of its derivatives) to include one feature or more, does not exclude the possibility of also including further features.

What is claimed is:

1. A method of forming a field electron emission material, comprising the step of disposing on a substrate having an electrically conductive surface a plurality of electrically conductive particles, each with a layer of electrically insulating material disposed either in a first location between said conductive surface and said particle, or in a second location between said particle and the environment in which the field electron emission material is disposed, but not in both of said first and second locations, such that at least some of said particles form electron emission sites at said first or second locations where said electrically insulating material is disposed.

2. A method according to claim 1, wherein the dimension of said particles normal to the surface of the conductor is significantly greater than the thickness of said layer of insulating material.

3. A method according to claim 2, wherein said dimension substantially normal to the surface of said particle is at least 10 times greater than said thickness.

4. A method according to claim 3, wherein said dimension substantially normal to the surface of said particle is at least 100 times greater than each said thickness.

5. A method according to claim 1, wherein the thickness of said insulating material is in the range 10 nm to 100 nm (100 Å to 1000 Å) and said particle dimension is in the range 1 $\mu$m to 10 $\mu$m.

6. A method according to claim 1, wherein there is provided a substantially single layer of said conductive particles each having their dimension substantially normal to the surface in the range 0.1 $\mu$m to 400 $\mu$m.

7. A method according to claim 1, wherein said insulating material comprises a material other than diamond.

8. A method according to claim 1, wherein said insulating material is an inorganic material.

9. A method according to claim 1, wherein said insulating material comprises a glass, lead based glass, glass ceramic, melted glass or other glassy material, ceramic, oxide ceramic, oxidised surface, nitride, nitrided surface, boride ceramic, diamond, diamond-like carbon or tetragonal amorphous carbon.

10. A method according to claim 1, wherein each said electrically conductive particle is substantially symmetrical.

11. A method according to claim 1, wherein each said electrically conductive particle is of substantially rough-hewn cuboid shape.

12. A method according to claim 1, wherein each said electrically conductive particle is of substantially spheroid shape with a textured surface.

13. A method according to claim 1, wherein said conductive particles each have a longest dimension and are preferentially aligned with their longest dimension substantially normal to the substrate.

14. A method according to claim 1, wherein said conductive particles having a mutual spacing, centre-to-centre, of at least 1.8 times their smallest dimension.

15. A method according to claim 1, wherein each said particle is, or at least some of said particles are, selected from the group comprising metals, semiconductors, electrical conductors, graphite, silicon carbide, tantalum carbide, hafnium carbide, zirconium carbide, boron carbide, titanium diboride, titanium carbide, titanium carbonitride, the Magneli sub-oxides of titanium, semi-conducting silicon, III–V compounds and II–VI compounds.

16. A method according to claim 1, wherein each said particle, or at least some of said particles, are only partially covered in said insulating material, and each such particle comprises a gettering material.

17. A method according to claim 1, wherein said surface is coated with said particles by means of an ink containing said particles and said insulating material to form said insulating layer, the properties of said ink being such that said particles have portions which are caused to project from said insulating material, uncoated by the insulating material, as a result of the coating process.

18. A method according to claim 17, wherein said ink is applied to said electrically conductive surface by a printing process.

19. A method according to claim 1, wherein said electrically conductive particles and/or electrically insulating material are applied to said electrically conductive substrate in a photosensitive binder to permit later patterning.

20. A method according to claim 1, wherein said insulating material is formed by the step of fusing, sintering or otherwise joining together a mixture of particles or in situ chemical reaction.

21. A method according to claim 20, wherein the insulating material comprises a glass, glass ceramic, ceramic, oxide ceramic, oxide, nitride, boride, diamond, polymer or resin.

22. A method according to claim 1, wherein each said electrically conductive particle comprises a fibre chopped into a length longer than its diameter.

23. A method according to any of claim 1, wherein said particles are formed by the deposition of a conducting layer upon said insulating layer and subsequent patterning, either by selective etching or masking, to form isolated islands that function as said particles.

24. A method according to claim 1, wherein said particles are applied to said conductive surface by a spraying process.

25. A method according to claim 1, wherein said conductive particles are formed by depositing a layer that subsequently crazes, or is caused to craze, into substantially electrically isolated raised flakes.

26. A method according to claim 23, wherein said conducting layer comprises a metal, conducting element or compound, semiconductor or composite.

27. A method according to claim 1, wherein the distribution of said sites over the field electron emission material is random.

28. A method according to claim 1, wherein said sites are distributed over the field electron emission material at an average density of at least $10^2$ $cm^{-2}$.

29. A method according to claim 1, wherein said sites are distributed over the field electron emission material at an average density of at least $10^3$ $cm^{-2}$, $10^4$ $cm^{-2}$ or $10^5$ $cm^{-2}$.

30. A method according to claim 1, wherein the distribution of said sites over the field electron emission material is substantially uniform.

31. A method according to claim 30, wherein the distribution of said sites over the field electron emission material has a uniformity such that the density of said sites in any circular area of 1 mm diameter does not vary by more than 20% from the average density of distribution of sites for all of the field electron emission material.

32. A method according to claim 30, wherein the distribution of said sites over the field electron emission material when using a circular measurement area of 1 mm in diameter is substantially Binomial or Poisson.

33. A method according to claim 30, wherein the distribution of said sites over the field electron emission material has a uniformity such that there is at least a 50% probability of at least one emitting site being located in any circular area of 4 $\mu$m diameter.

34. A method according to claim 30, wherein the distribution of said sites over the field electron emission material has a uniformity such that there is at least a 50% probability of at least one emitting site being located in any circular area of 10 $\mu$m diameter.

35. A method according to any of the preceding claims, including the preliminary step of classifying said particles by passing a liquid containing particles through a settling tank in which particles over a predetermined size settle such that liquid output from said tank contains particles which are less than said predetermined size and which are then coated on said substrate.

36. A method according to claim 24, wherein said conducting layer comprises a metal conducting element or compound, semiconductor or composite.

37. A method according to claim 25, wherein said conducting layer comprises a metal conducting element or compound, semiconductor or composite.

38. A field electron emission material produced by a method according to claim 1.

39. A field electron emission device comprising a field electron emission material according to claim 38 and means for subjecting said material to an electric field in order to cause said material to emit electrons.

40. A field electron emission device according to claim 39, comprising a substrate with an array of emitter patches of said field electron emission material, and control electrodes with aligned arrays of apertures, which electrodes are supported above the emitter patches by insulating layers.

41. A field electron emission device according to claim 40, wherein said apertures are in the form of slots.

42. A field electron emission device according to claim 39, comprising a plasma reactor, corona discharge device, silent discharge device, ozoniser, an electron source, electron gun, electron device, x-ray tube, vacuum gauge, gas filled device or ion thruster.

43. A field electron emission device according to claim 39, wherein the field electron emission material supplies the total current for operation of the device.

44. A field electron emission device according to any of claims 39 to 42, wherein the field electron emission material supplies a starting, triggering or priming current for the device.

45. A field electron emission device according to claim 39, comprising a display device.

46. A field electron emission device according to claim 39, comprising a lamp.

47. A field electron emission device according to claim 46, wherein said lamp is substantially flat.

48. A field electron emission device according to claim 39, comprising an electrode plate supported on insulating spacers in the form of a cross-shaped structure.

49. A field electron emission device according to claim 39, wherein, the field electron emission material is applied in patches which are connected in use to an applied cathode voltage via a resistor.

50. A field electron emission device according to claim 49, wherein said resistor is applied as a resistive pad under each emitting patch.

51. A field electron emission device according to claim 50, wherein a respective said resistive pad is provided under each emitting patch, such that the area of each such resistive pad is greater than that of the respective emitting patch.

52. A field electron emission device according to claim 39, wherein said emitter material and/or a phosphor is/are disposed upon one or more one-dimensional array of conductive tracks which are arranged to be addressed by electronic driving means so as to produce a scanning illuminated line.

53. A field electron emission device according to claim 52, including said electronic driving means.

54. A field electron emission device according to claim 39, wherein said environment is gaseous, liquid, solid, or a vacuum.

55. A field electron emission device according to claim 39, including a gettering material within the device.

56. A field electron emission device according to claim 55, wherein said gettering material is affixed to an anode of the device.

57. A field electron emission device according to claim 55, wherein said gettering material is affixed to a cathode of the device.

58. A field electron emission device according to claim 57, wherein said field electron emission material is arranged in patches, and said gettering material is disposed within said patches.

59. A field electron emission device according to claim 55, comprising an anode, a cathode, spacer sites on said anode and cathode, spacers located at at least some of said spacer sites to space said anode from said cathode, and said gettering material located on said anode at others of said spacer sites where spacers are not located.

60. A field electron emission device according to claim 59, wherein said spacer sites are at a regular or periodic mutual spacing.

61. A field electron emission device according to claim 39, wherein a cathode of the device is optically translucent and so arranged in relation to an anode of the device that electrons emitted from the cathode impinge upon the anode to cause electro-luminescence at the anode, which electro-luminescence is visible through the optically translucent cathode.

* * * * *